US007971322B2

(12) United States Patent
Jaw

(10) Patent No.: US 7,971,322 B2
(45) Date of Patent: Jul. 5, 2011

(54) GRIP DESIGNED FOR A HANDLE AND METHOD OF MAKING THE SAME

(76) Inventor: Leo Jaw, Taichung Hsien (TW)

( * ) Notice: Subject to any disclaimer, the term of this patent is extended or adjusted under 35 U.S.C. 154(b) by 395 days.

(21) Appl. No.: 12/103,736

(22) Filed: Apr. 16, 2008

(65) Prior Publication Data

US 2009/0260189 A1 Oct. 22, 2009

(51) Int. Cl.
*B25G 1/10* (2006.01)

(52) U.S. Cl. ..... 16/421; 29/428; 473/301

(58) Field of Classification Search ..... 16/142, 16/101.1; 29/592, 428, 557, 104, 242; 473/300–301; 69/21; 428/473, 904
See application file for complete search history.

(56) References Cited

U.S. PATENT DOCUMENTS 2,339,121 A * 1/1944 Van Cleef ..... 156/162
4,082,277 A * 4/1978 Van Auken et al. ..... 473/320
4,567,091 A * 1/1986 Spector ..... 428/222
5,634,859 A * 6/1997 Nesbitt ..... 473/301
6,558,270 B2 * 5/2003 Kwitek ..... 473/301
2003/0150081 A1 * 8/2003 Wang ..... 16/110.1
2004/0123429 A1 * 7/2004 Wang ..... 16/436

FOREIGN PATENT DOCUMENTS

CN 2640544 9/2004

OTHER PUBLICATIONS

Taiwanese Utility Model Publication No. TW M244939, Oct. 1, 2004, 6 pages.
Taiwanese Utility Model Publication No. TW M305037, Jan. 21, 2007, 8 pages.

* cited by examiner

*Primary Examiner* — William L. Miller
(74) *Attorney, Agent, or Firm* — Alan Kamrath; Kamrath & Associates PA

(57) ABSTRACT

A grip designed for a handle has a quality of unidirectional extendibility and is extended in a direction in accordance with a direction of extendibility for wrapping the handle. A method for making a grip designed for a handle includes preparing a sheet that has the quality of unidirectional extendibility; trimming the grip from the sheet; and extending the grip in a direction in accordance with the direction of unidirectional extendibility for wrapping the handle.

4 Claims, 11 Drawing Sheets

GRIP DESIGNED FOR A HANDLE AND METHOD OF MAKING THE SAME

BACKGROUND OF THE INVENTION

1. Field of the Invention

The present invention relates to a grip designed for a handle and its method of making and, in particular, to a grip that can extend easily in the direction of wrapping on a handle.

2. Description of the Related Art

China Pat. No. CN2640544 discloses a handle protecting belt including a first strap, a second strap made of rubber material, and a third strap made of polyurethanes (PU) or EVA, depending upon whether the handle protecting belt is intended to be held in comfort or whether the handle protecting belt is intended to be provided with a better shock-absorbing quality.

While these straps are made of material that has extendibility, these straps do not form the protecting belt that can be easily pulled to wrap onto a handle. As a result, it is thus desirable to provide a belt that can be more easily wrapped onto a handle or an article for which it is designed.

The present invention is, therefore, intended to obviate or at least alleviate the problems encountered in the prior art.

SUMMARY OF THE INVENTION

Accordingly, the present invention discloses a grip designed for a handle that has a quality of unidirectional extendibility and that is extended in a direction in accordance with a direction of extendibility for wrapping the handle.

In one embodiment, the grip is extended circumferentially around the handle and makes a left side and a right side thereof have a connection therebetween, such that the connection creates a seam line in accordance with a lengthwise direction of a handle.

In another embodiment, one of the left side and the right side is extended circumferentially upward around the handle, and the other of the left side and the right side is extended circumferentially downward around the handle, such that the grip is spirally formed along the lengthwise direction of the handle.

Accordingly, the present invention is discloses a method for making a grip designed for a handle. The method includes preparing a sheet that has a quality of unidirectional extendibility; trimming the grip from the sheet with the grip including a first side and a second side; and extending the first and the second sides in a direction in accordance with a direction of extendibility for wrapping the handle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

BRIEF DESCRIPTION OF THE DRAWINGS

For the present disclosure to be easily understood and readily practiced, the present disclosure will now be described in conjunction with the following figures, wherein.

DETAILED DESCRIPTION OF THE PREFERRED EMBODIMENT

Figure 2:
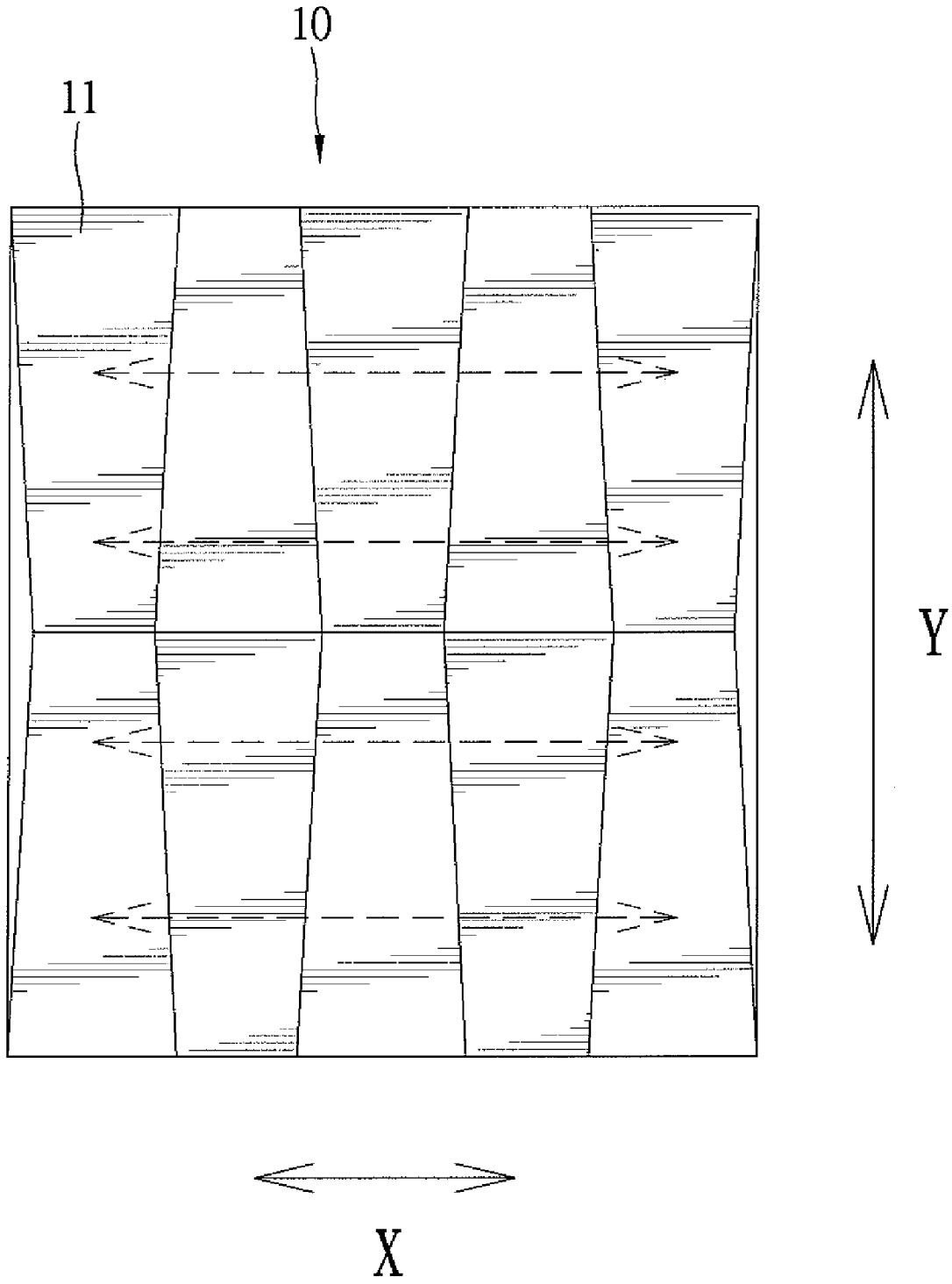
FIG. 2 shows a sheet adapted to be used for making the grip.
Figure 3:
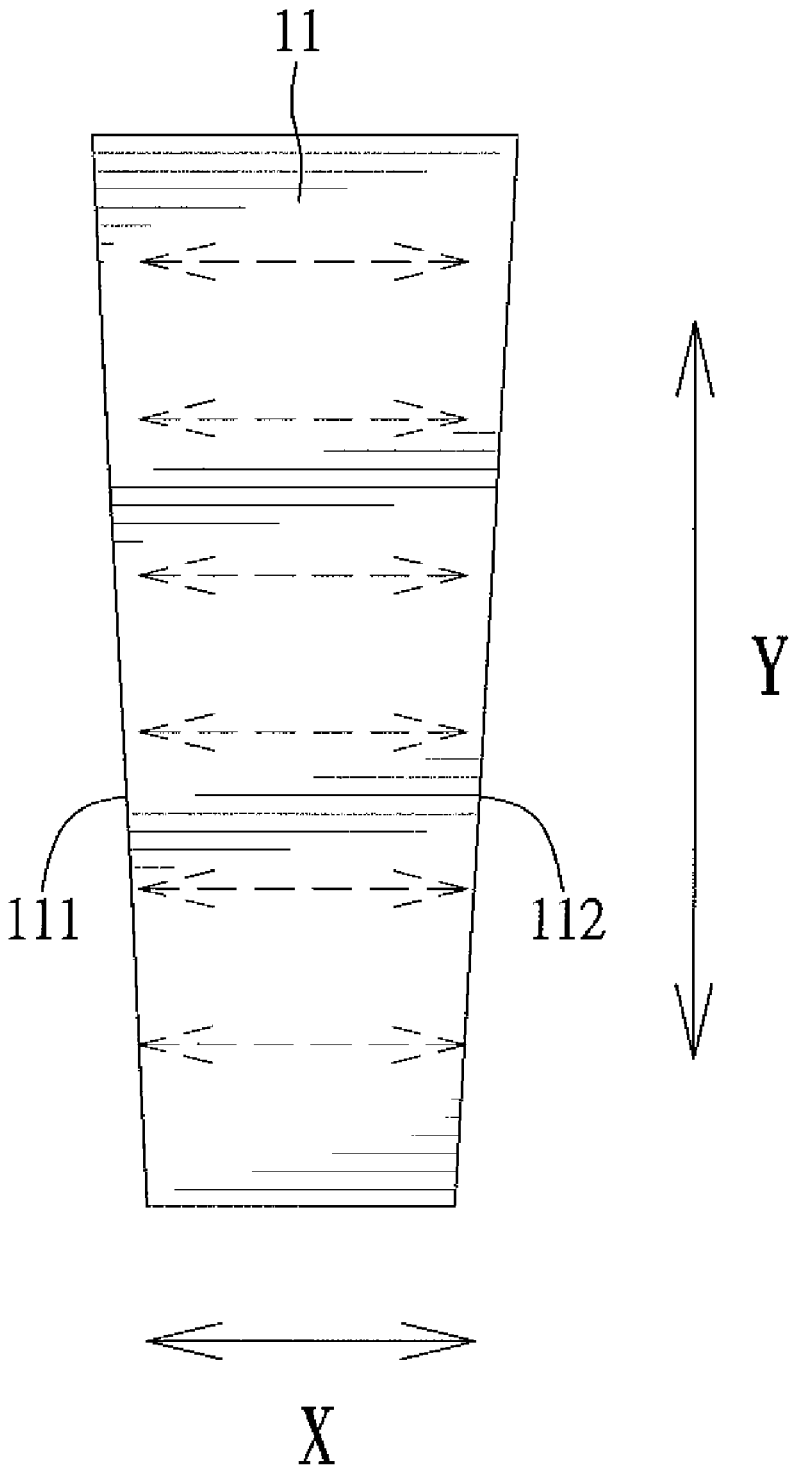
FIG. 3 shows one grip of the first embodiment of the present invention.

Referring to FIGS. 2 and 3, a grip 11 designed for a handle is trimmed from a sheet 10 that has a quality of unidirectional extendibility. Preferably, the sheet 10 is made from natural/synthetic leather, as it is understood that this material has a good quality of unidirectional extendibility.

In this embodiment, the sheet 10 has the extendibility in accordance with a double-headed arrow X (as indicated by phantom arrows) and, the grip 11 has a left side 111 that can be stretched in accordance with the left arrow head of the double-headed arrow X and a right side 112 that can be stretched in accordance with the right arrow head of the double-headed arrow X. It should be understood the term "right", "left" and "X" used herein have reference only to the structure shown in the drawings.

FIG. 2 also shows that a plurality of grips 11 can be produced in one sheet 10, for instance, 10 grips here.

Figure 4:
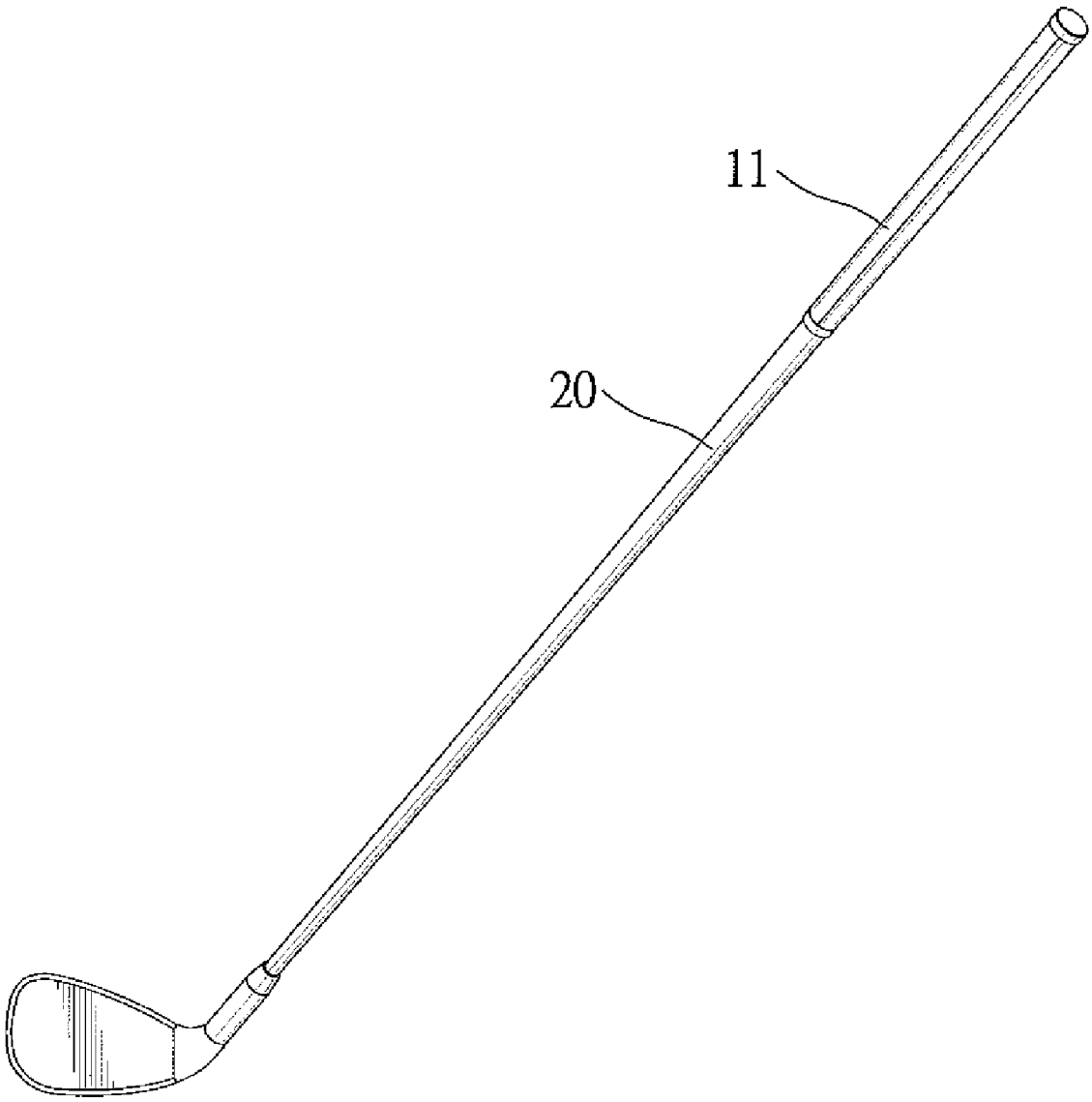
FIG. 4 shows the grip in FIG. 3 wrapped onto a handle.

FIG. 4 shows that when the grip 11 is wrapped onto a handle 20, the grip 11 is extended in a direction in accordance with a direction of extendibility, and the left side 111 and the right side 112 are extended circumferentially around a handle 20 to make a connection therebetween, such that the connection creates a seam line in accordance with a lengthwise direction of the handle 20.

Figure 6:
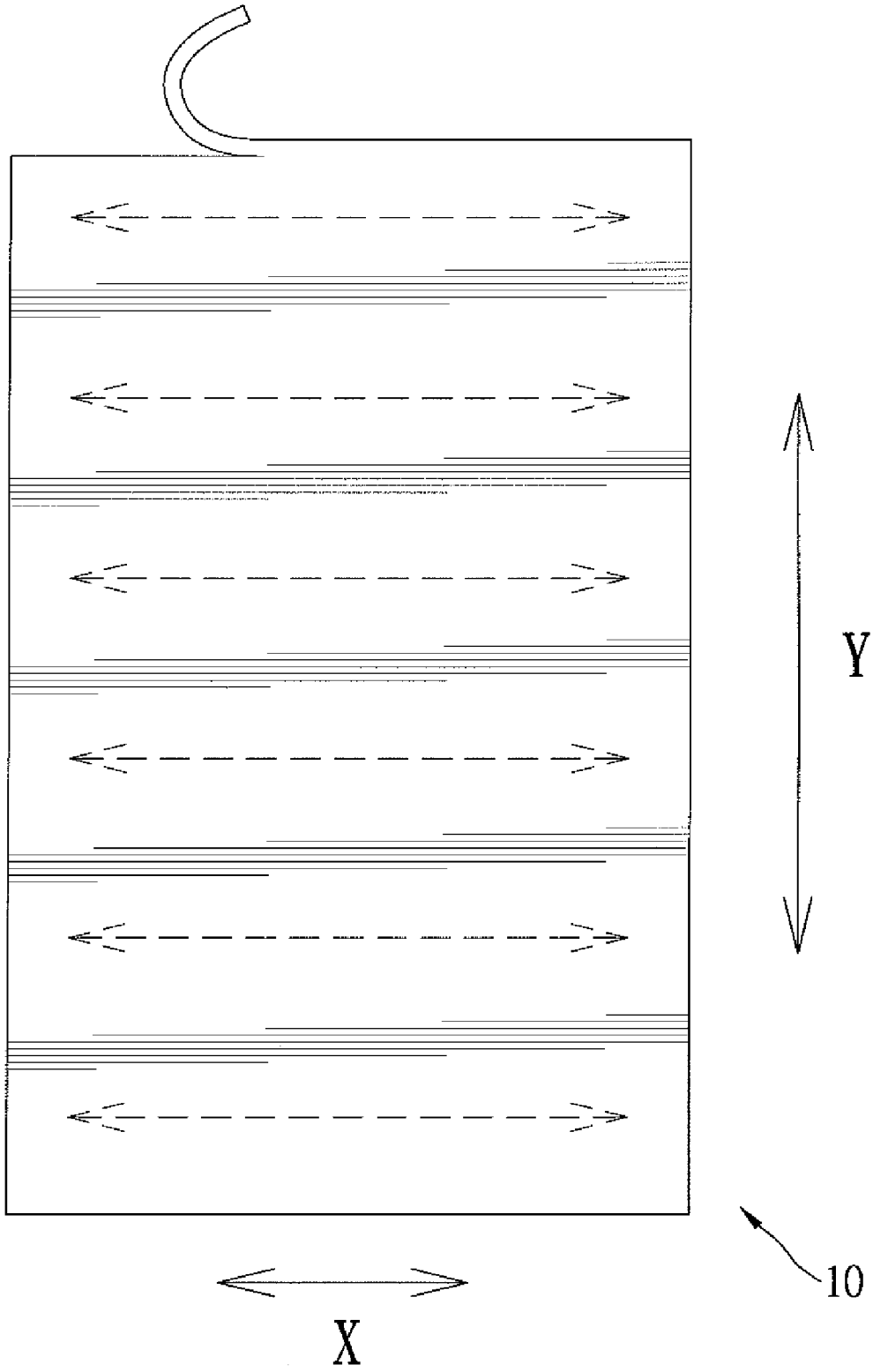
FIG. 6 is an illustrative view showing how the grip of the second embodiment of the present invention is formed from the sheet in FIG. 2.
Figure 7:
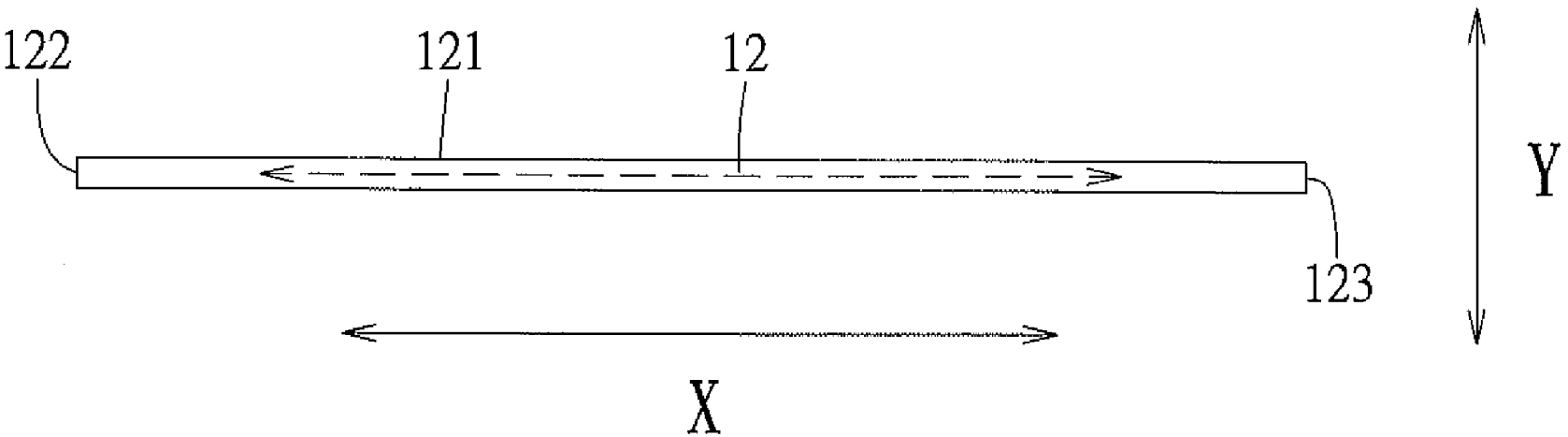
FIG. 7 shows one grip of the second embodiment of the present invention.

Referring to FIGS. 6 and 7, a grip 12 designed for the handle 20 in accordance with a second embodiment of the present invention is trimmed from the sheet 10 in one of the directions in accordance with an arrow head of the double-headed arrow X. The grip 12 has two parallel sides 121 extending in a direction in accordance with the double-headed arrow X and a left side 122 and a right side 123 interconnecting the parallel sides 121, respectively. Preferably, the sides 121 are relatively longer than the left side 122 and the right side 123.

Figure 8:
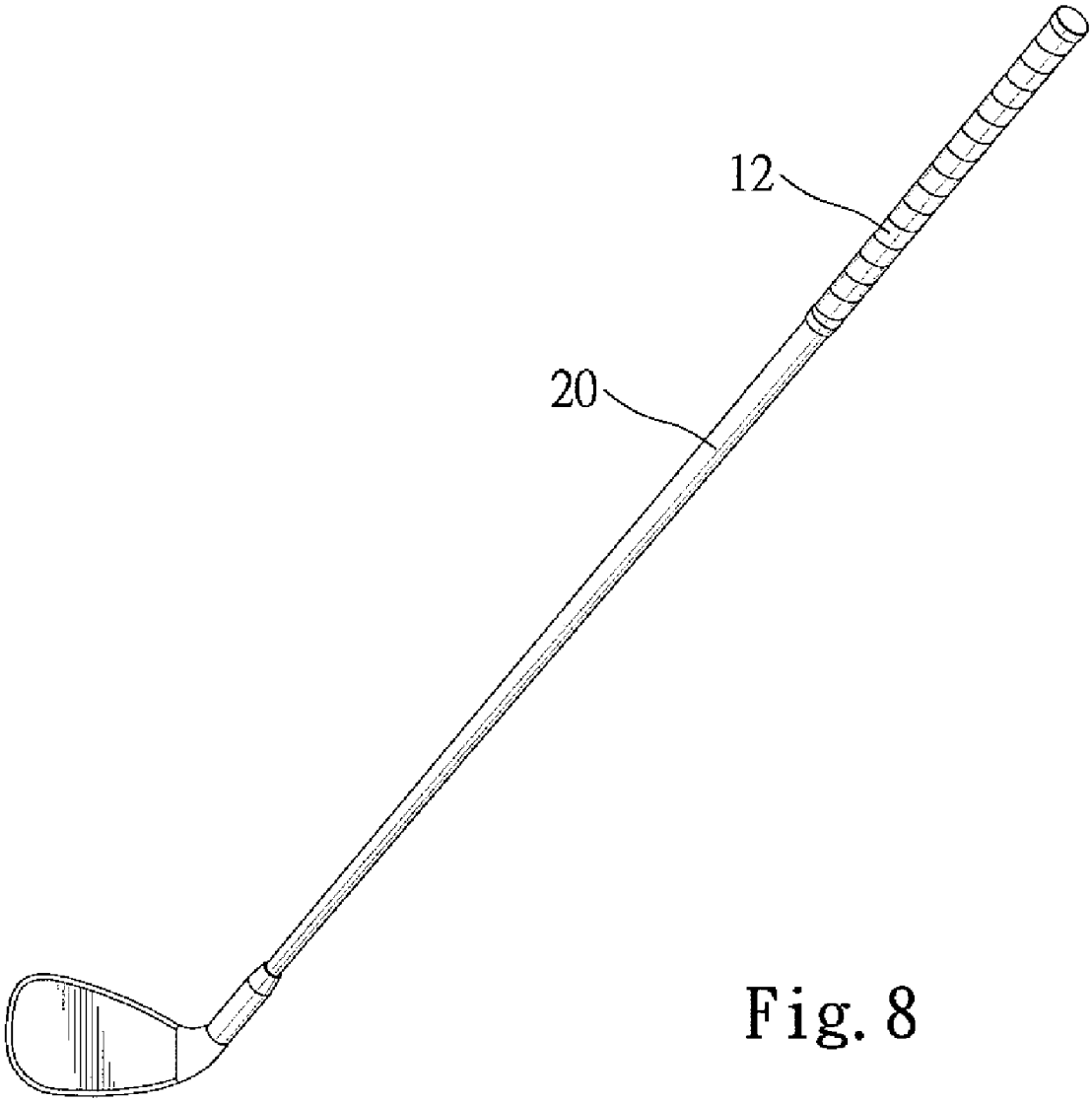
FIG. 8 shows the grip in FIG. 7 wrapped onto a handle.

FIG. 8 shows that when the grip 12 is wrapped onto the handle 20, the grip 12 is extended in a direction in accordance with a direction of extendibility, and one of the sides 122 and 123 is extended circumferentially upward and the other of the sides 122 and 123 circumferentially downward, such that the grip 12 is spirally formed along the lengthwise direction of the handle 20.

Figure 10:
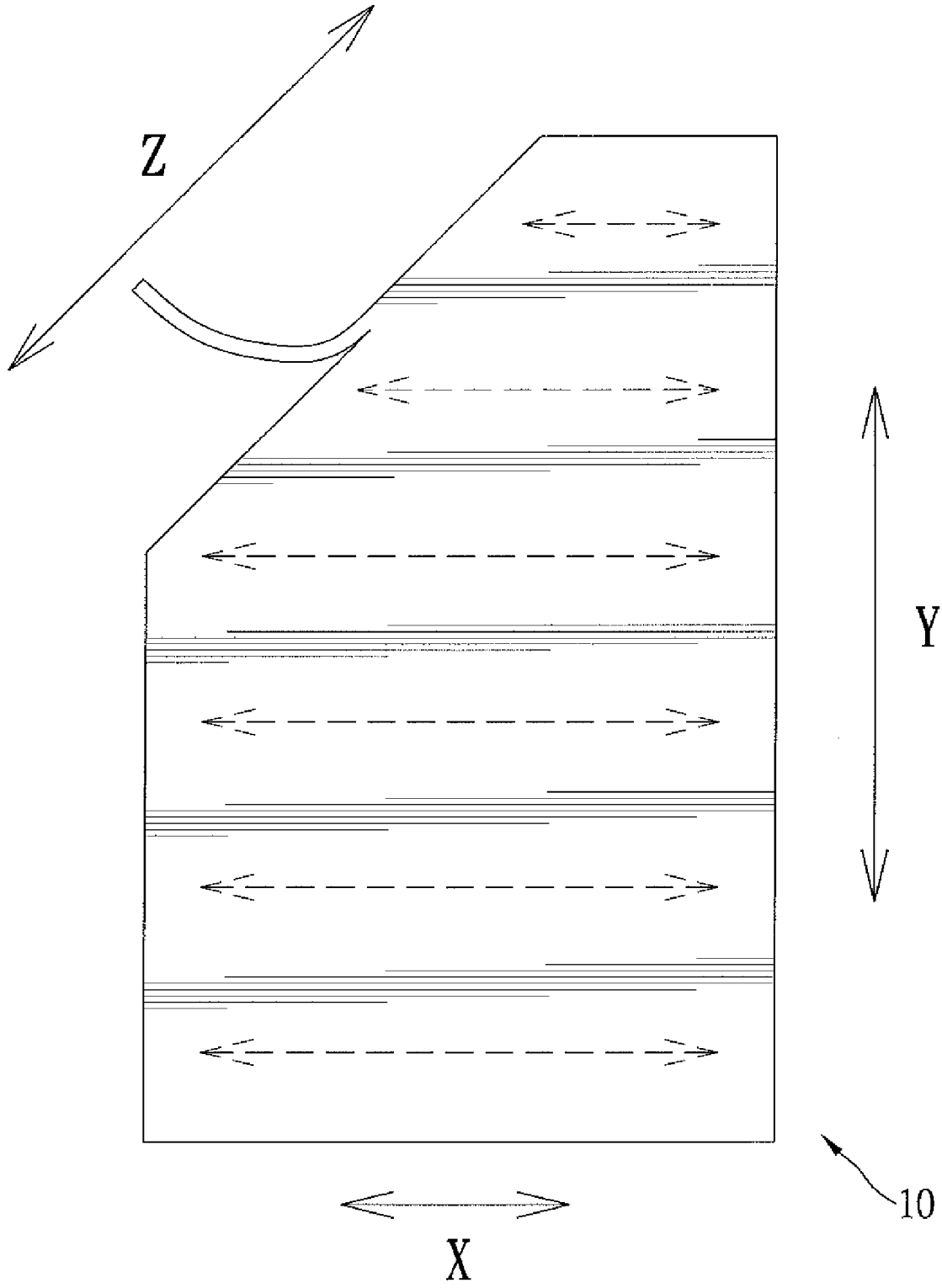
FIG. 10 is an illustrative view showing how the grip of the third embodiment of the present invention is formed from the sheet in FIG. 2.
Figure 11:
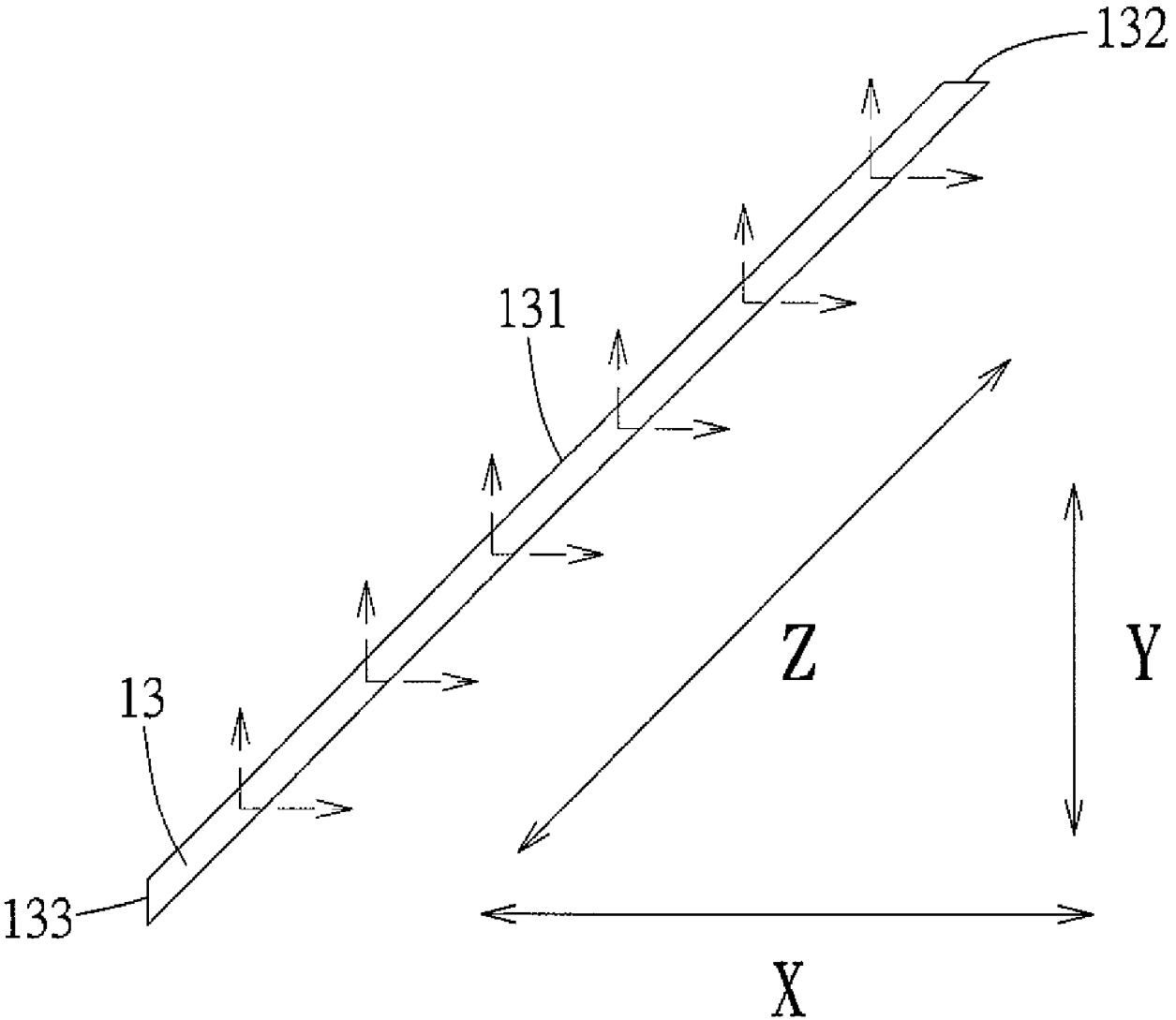
FIG. 11 shows one grip of the third embodiment of the present invention.

Referring to FIGS. 10 and 11, a grip 13 designed for the handle 20 in accordance with a third embodiment of the present invention is trimmed from the sheet 10 in one of the directions in accordance with an arrow head of the double-headed arrow Z. The grip 13 has two parallel sides 131 extending in accordance with the double-headed arrow Z and a right side 132 and a left side 133 interconnecting the parallel sides 131, respectively. Preferably, the sides 131 are relatively longer than the right side 132 and the left side 133.

In this embodiment, the arrow Z cooperates with the arrow X to define an angle ranging from 30°-60°. Preferably, this angle is 45°. Further, the arrow Z cooperates with arrow Y to define an angle ranging from 30°-60°. Preferably, this angle is 45°. Further, the arrow X cooperates with the arrow Y to define an angle of 90°.

By trimming the grip 13 in this manner, the grip 13 has a quality of extendibility in accordance with the double-headed arrow X as well as a quality of extendibility in accordance with the double-headed arrow Y (as indicated by phantom arrows).

When the grip 13 is to be wrapped on the handle 20, the grip 13 is extended in a direction in accordance with a direction of extendibility. One of the sides 132 and 133 is extended circumferentially upward, and the other of the sides 132 and 133 is extended circumferentially downward, such that the grip 13 is spirally formed along the lengthwise direction of the handle 20.

Figure 1:
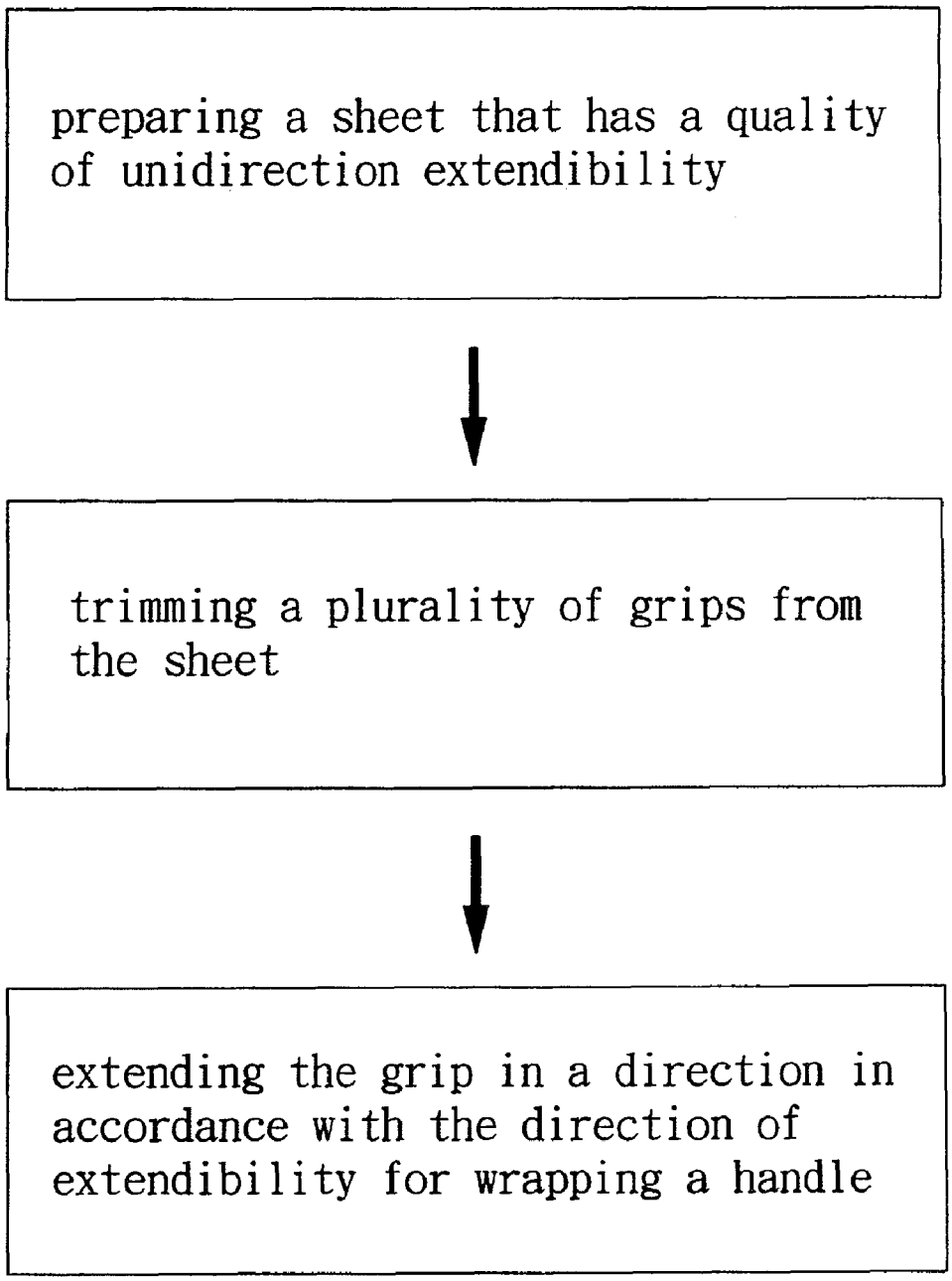
FIG. 1 shows a process of making a grip in accordance with a first embodiment of the present invention.

Referring now to FIG. 1, a process of making the grip 11 designed for the handle 20 in accordance with a first embodiment of the present invention includes preparing the sheet 10 that has a quality of unidirectional extendibility; trimming the grip 11 from the sheet 10; and extending the grip 11 in a direction in accordance with a direction of extendibility to make the left side and the right side 111 and 112 thereof have a connection therebetween such that the connection creates a seam line in accordance with the lengthwise direction of the handle 20.

Preferably, the sheet 10 is made from natural/synthetic leather, and a plurality of grips 11 can be trimmed from one sheet 10.

Figure 5:
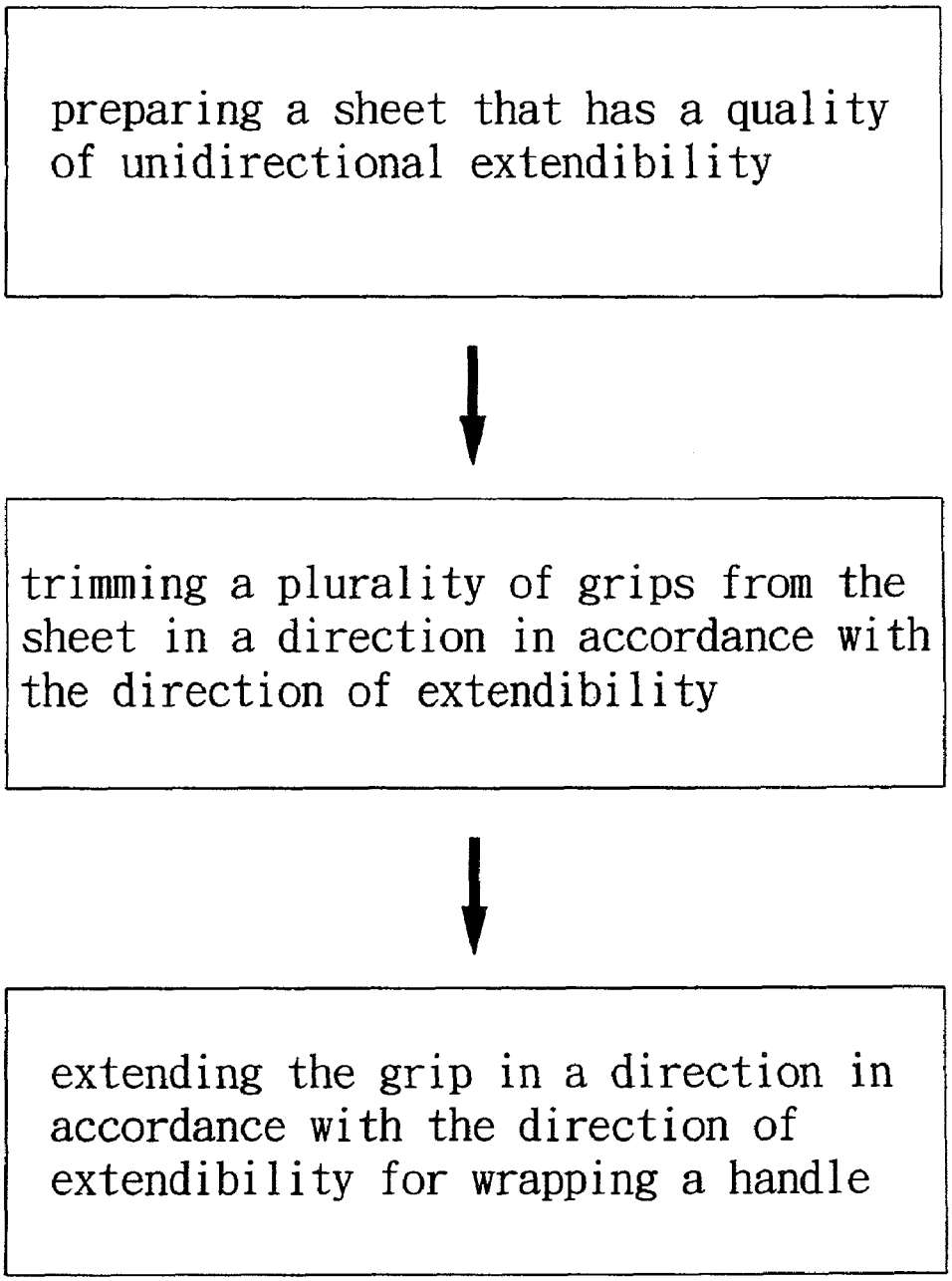
FIG. 5 shows a process of making a grip in accordance with a second embodiment of the present invention.

Referring to FIG. 5, the process of making the grip 12 designed for the handle 20 in accordance with a second embodiment of the present invention includes preparing the sheet 10 that has a quality of unidirectional extendibility; trimming the grip 12 in a direction in accordance with a direction of extendibility; and then extending the grip 12 in a direction in accordance with a direction of extendibility and one of the sides 122 and 123 thereof upward and the other of the sides 122 and 123 downward such that the grip 12 is spirally formed along the lengthwise direction of the handle 20.

Preferably, the sheet 10 is made from natural/synthetic leather, and a plurality of grips 12 can be trimmed from one sheet 10.

Preferably, the grip 12 has two parallel sides 121 in accordance with the direction of trim, and the sides 121 are relatively longer than the left side 122 and the right side 123.

Figure 9:
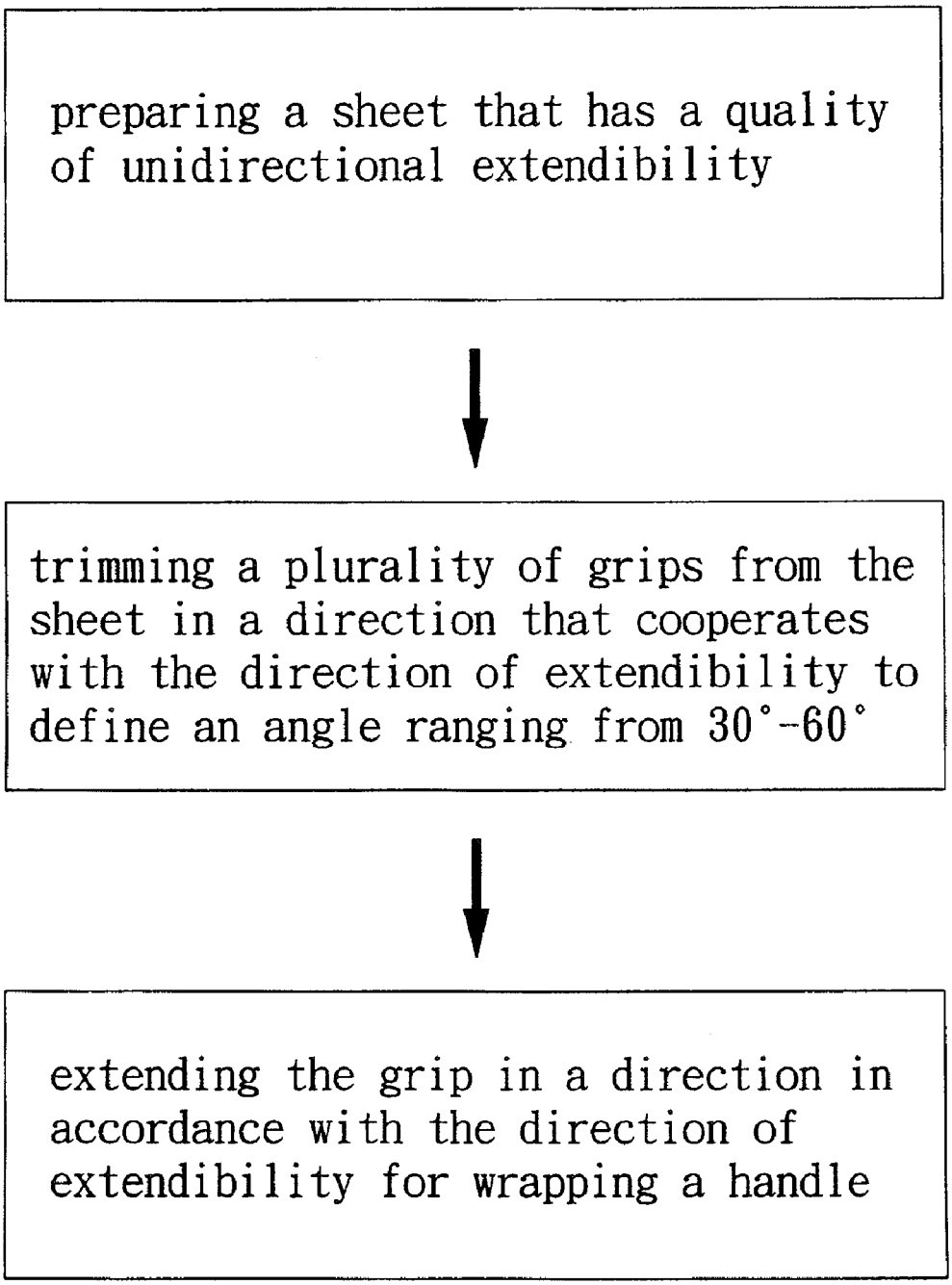
FIG. 9 shows a process of making a grip in accordance with a third embodiment of the present invention.

Referring to FIG. 9, the process of making Hall the grip 13 designed for the handle 20 in accordance with a third embodiment of the present invention includes preparing the sheet 10 that has a quality of unidirectional extendibility; trimming the grip 13 in a direction that cooperates with a direction of extendibility to define an angle ranging from 30°-60°; and extending the grip 13 in a direction in accordance with a direction of extendibility and one of the sides 132 and 133 thereof upward and the other of the sides downward, such that the grip 13 is spirally formed along the lengthwise direction of the handle 20.

Preferably, the sheet 10 is made from natural/synthetic leather, and a plurality of grips 13 can be trimmed from one sheet 10.

Preferably, the grip 13 has two parallel sides 131 in accordance with the direction of trim, and the sides 131 are relatively longer than the right side 132 and the left side 133.

While the specific embodiments have been illustrated and described, numerous modifications come to mind without significantly departing from the spirit of invention and the scope of invention is only limited by the scope of accompanying claims.

What is claimed is:

1. A method comprising:

preparing a natural or synthetic leather sheet having unidirectional extendibility in a direction of extendibility;

trimming a grip from the sheet with the grip having two parallel sides, wherein the two parallel sides of the grip are trimmed to cooperate with the direction of extendibility to define an angle ranging from 30°-60°; and wrapping a handle with the grip by extending the two parallel sides of the grip in the direction of extendibility.

2. The method as claimed in claim 1 wherein the angle is 45°.

3. The method as claimed in claim 2 wherein the grip has a first side and a second side interconnecting the two parallel sides, with one of the first side and the second side extending circumferentially upward and the other of the first and the second sides extending circumferentially downward.

4. The method as claimed in claim 1 wherein the grip has a first side and a second side interconnecting the two parallel sides, with one of the first side and the second side extending circumferentially upward and the other of the first and the second sides extending circumferentially downward.

* * * * *